US007488239B2

(12) United States Patent
Tamm

(10) Patent No.: US 7,488,239 B2
(45) Date of Patent: Feb. 10, 2009

(54) ASSEMBLY FOR GRINDING ELECTRODES

(76) Inventor: Rolf Tamm, 8 Am Fohrenbuhl, Salem 88682 (DE)

( * ) Notice: Subject to any disclaimer, the term of this patent is extended or adjusted under 35 U.S.C. 154(b) by 0 days.

(21) Appl. No.: 11/704,416

(22) Filed: Feb. 8, 2007

(65) Prior Publication Data

US 2008/0108284 A1 May 8, 2008

(30) Foreign Application Priority Data

Nov. 8, 2006 (DE) ..... 10 2006 052 904
Nov. 8, 2006 (DE) ..... 10 2006 052 905

(51) Int. Cl.
*B24B 19/16* (2006.01)

(52) U.S. Cl. ..... 451/282; 451/359

(58) Field of Classification Search ..... 451/282, 451/283, 267, 268, 451, 454, 457, 359
See application file for complete search history.

(56) References Cited

U.S. PATENT DOCUMENTS 5,210,977 A * 5/1993 Werner ..... 451/283
5,676,591 A * 10/1997 Huang ..... 451/359
6,106,372 A 8/2000 Clark
6,195,860 B1 3/2001 Di Rosa et al.
6,918,823 B2 7/2005 Tamm

FOREIGN PATENT DOCUMENTS

DE 41 07 462 C2 5/1997
DE 100 10 520 A1 9/2001
DE 699 02 339 T2 3/2003
DE 102 08 914 A1 9/2003
DE 102 43 210 B3 5/2005

* cited by examiner

*Primary Examiner*—Robert Rose
(74) *Attorney, Agent, or Firm*—Lawrence G. Fridman

(57) ABSTRACT

A device for grinding welding electrodes comprises a driving motor, a shaft driven by said driving motor and a grinding wheel driven by said driving motor through said shaft, said grinding wheel having a first and a second grinding surface. A first guiding block is provided having at least one first opening, said first opening defining a position relative to said first grinding surface and said opening being adapted to guide a welding electrode for grinding into said defined position relative to said first grinding surface, and a second guiding block having at least one second opening, said second opening defining a position relative to said second grinding surface and said second opening being adapted to guide a welding electrode for grinding into said defined position relative to said second grinding surface.

18 Claims, 17 Drawing Sheets

ASSEMBLY FOR GRINDING ELECTRODES

BACKGROUND OF THE INVENTION

Welding electrodes consist of a very hard material such as tungsten with high stability even at high temperatures. There are welding electrodes with different cross sections. The welding electrodes have a tip or an edge at its end. The form of the welding electrodes depends on their respective application. Such tips suffer from wear during operation.

Welding electrodes can be bought with pre-manufactured tips. The tip is worn after its use. The welding electrodes are then discarded. This is expensive because high-quality material is expensive.

It is known to regrind used welding electrodes. This is usually carried out manually on open grinding- or cutting-off wheels. This method is inaccurate and dangerous. Furthermore devices are known with an open grinding wheel wherein the welding electrodes are guided at a certain angle with respect to the grinding wheel by a guiding sleeve. Such devices are also expensive. It is especially expensive to adapt the device to match the various types of welding electrodes or the various shapes of the tips or cutting edges. This requires the exchange of the guiding sleeves.

A device for producing electrodes with a plurality (for example 6) of different electrode cross sections with a plurality of different tip angles (for example 4) and a plurality of lengths is a useful and cost-saving means.

From the DE 100 10 520 A1 a device for processing welding electrodes with a grinding wheel is known. The grinding wheel rotates within a grinding wheel housing. The device also has a housing cap fixed to the grinding wheel housing and having at least one lateral opening for guiding a welding electrode for processing into a defined position relative to the grinding wheel. The plane of the grinding wheel is essentially the separating plane between the grinding wheel housing and the cap. The cap can have a plurality of different lateral openings spaced apart for receiving different types of welding electrodes. The cap can also have a plurality of lateral openings spaced apart with axes crossing the plane of the grinding wheel at different angles. A radial slit can be formed in the grinding wheel housing extending over the front surface of the housing. A welding electrode can be guided through the slit for cutting at the lateral surface of the grinding wheel. In the disclosed device the grinding wheel is fixed to a grinding wheel seat which is connected to the shaft of the driving motor. The entire device is a portable unit.

The device known from the prior art allows the grinding of thick electrodes as well as thin electrodes. It is, however, a disadvantage that the grinding wheel which is required to achieve a fine grinding result has only a small grinding rate. This is particularly disadvantageous with thick electrodes. Therefore, each time, when a high grinding rate is necessary the fine grinding wheel has to be replaced by a rougher grinding wheel. This is time consuming.

US 2004/0127149 A1 to the applicant discloses an assembly, where two parallel grinding wheels with different graining are used. A first grinding wheel runs in a cavity between the motor flange and a first housing. The second grinding wheel runs in a second hollow space between the first housing and a second housing. The housings are provided with openings for guiding the welding electrodes. The known assembly allows the use of different grinding wheels without dismounting and re-assembling.

Thus, one object of the invention is to provide a less expensive assembly of the above mentioned kind with smaller diameters.

SUMMARY OF THE INVENTION

The invention relates to a device for grinding welding electrodes comprising a driving motor, a shaft driven by the driving motor, a grinding wheel driven by the driving motor through the shaft, the grinding wheel having a grinding surface, and a guiding block having at least one opening, the opening defining a position relative to the grinding surface and being adapted to guide a welding electrode for grinding into the defined position relative to the grinding surface.

According to one aspect of the invention device is provided for grinding welding electrodes comprising a driving motor; a shaft driven by said driving motor; a grinding wheel driven by said driving motor through said shaft, said grinding wheel having a first and a second grinding surface; a first guiding block having at least one first opening, said first opening defining a position relative to said first grinding surface and said opening being adapted to guide a welding electrode for grinding into said defined position relative to said first grinding surface, and a second guiding block having at least one second opening, said second opening defining a position relative to said second grinding surface and said second opening being adapted to guide a welding electrode for grinding into said defined position relative to said second grinding surface.

The assembly differs from known assemblies in so far as both grinding surfaces run in the same space. Therefore the entire assembly can be produced for less money, it is shorter and easier to handle.

It is understood, that the grinding wheel may comprise several layers. While a grinding wheel with two grinding surfaces is preferable, the grinding wheel may also comprise two grinding wheel portions each having one grinding surface. The grinding wheel portions may then be assembled with the grinding surfaces directed in opposite directions.

Only one grinding wheel assembly is used, which is, however, used from two sides. The openings extend in the direction of the top surface of the grinding wheel as well as in the direction of the bottom surface of the grinding wheel. The direction of the openings for guiding the welding electrodes in the direction of the bottom surface of the grinding wheel enables the use of the motor flange for the openings. The motor flange thereby constitutes a guiding block. As less additional guiding blocks are used the entire length of the driving shaft for the grinding wheel assembly is shorter. Less connecting elements are necessary also.

Preferably the grinding surfaces of the first and the second grinding surfaces have a different graining. If the first grinding surface is provided on a first grinding wheel and the second grinding surface is provided on a second grinding wheel a particularly cheap production is possible. The grinding wheels do not need to be provided with different grainings on the top surface and the bottom surface. Conventional grinding wheels with uniform graining may be used. The grinding wheels are disposed in the cavity in such a way, that the grinding surfaces are directed in opposite directions.

In a modification of the invention a wheel with a larger diameter is provided between the grinding wheels for lateral cutting of electrodes. In this case the electrodes may not only be grinded or re-grinded but also cut.

In another aspect of the invention a device for grinding welding electrodes is provided comprising a driving motor; a shaft driven by said driving motor; a grinding wheel driven by said driving motor through said shaft, said grinding wheel having a grinding surface; a guiding block having at least one opening, said opening defining a position relative to said grinding surface and said opening being adapted to guide a welding electrode for grinding into said defined position relative to said grinding surface, wherein said opening is provided in a portion of said guiding block directly engaging said motor housing, said portion having a first side directed towards said driving motor and a second side opposite to said first side, and wherein said grinding wheel is disposed on said second side of said portion of said guiding block. In other words: the motor flange is used as a guiding block. It is, therefore, provided with a plurality of openings

BRIEF DESCRIPTION OF THE DRAWINGS

The invention will be described herein below in greater detail with reference to the accompanying drawings in which.

DETAILED DESCRIPTION OF THE INVENTION

Figure 1:
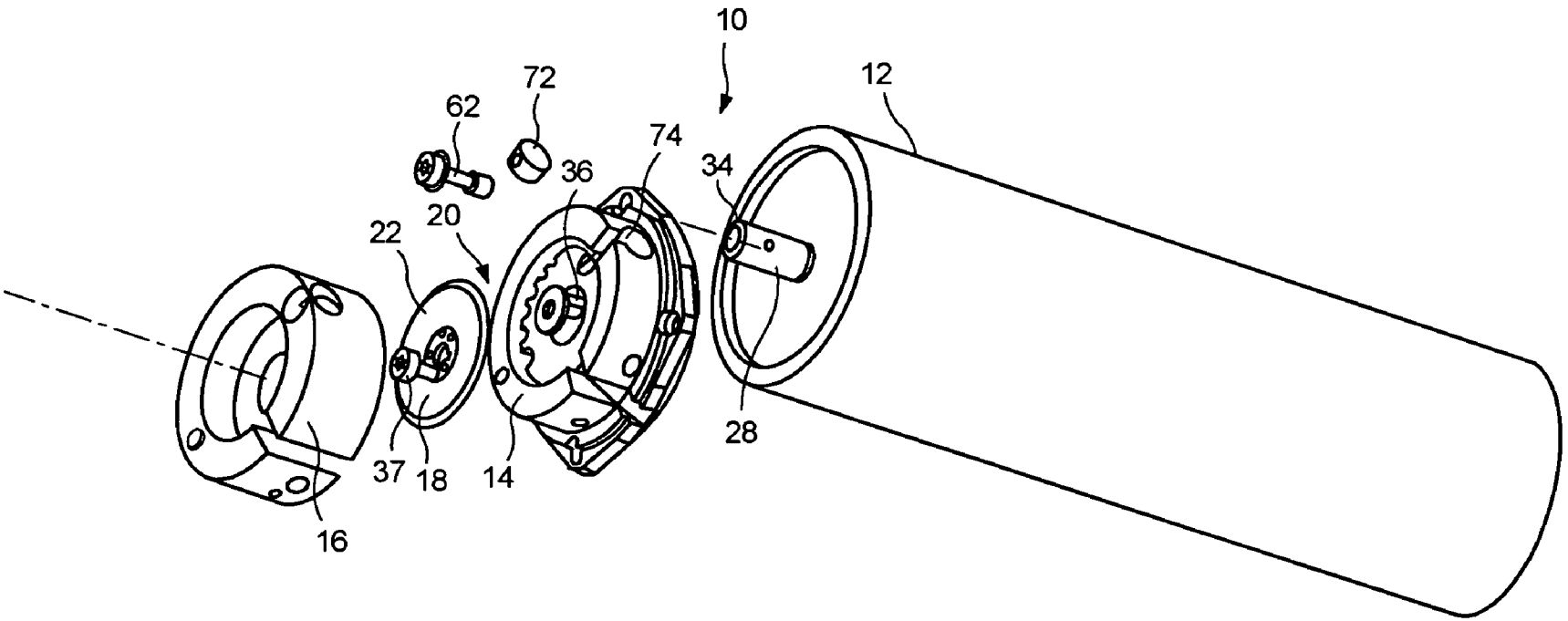
FIG. 1 is an exploded view of a device for processing welding electrodes with several connected grinding wheels with a view from the upper end on the housing components according to a first embodiment of the invention.

Referring now to the drawings, wherein numeral 10 in the drawings generally denotes a device for grinding tungsten welding electrodes. The device 10 comprises a motor (not shown) in a motor housing 12, a motor flange 14 screwed to the motor housing 12 and a cylindrical housing part 16 arranged on the motor flange 14. The motor flange 14 and the housing part 16 constitute guiding blocks for guiding electrodes. The housing part 16 is connected to the motor and the motor flange in a way which is described below in greater detail. A grinding wheel assembly 18 with grinding wheels 20 and 22 having different graining rotates in the plane between the motor flange 14 and the housing part 16.

Figure 3:
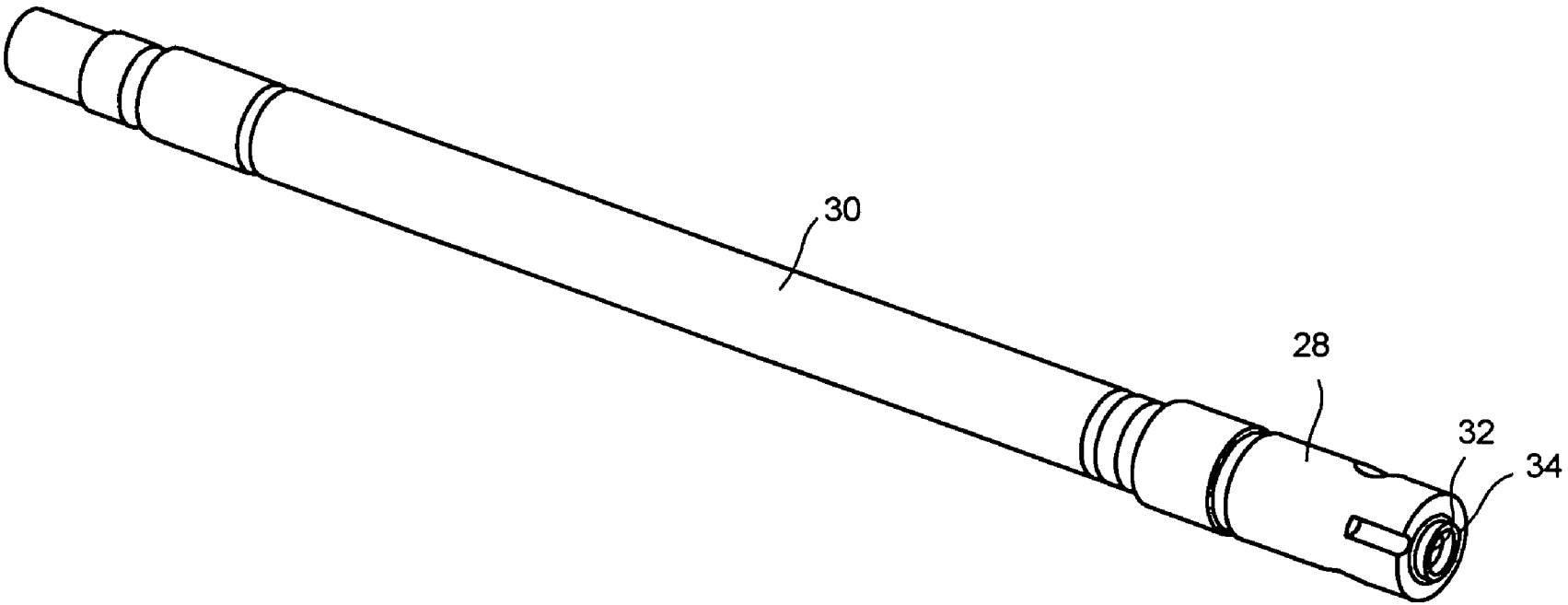
FIG. 3 is a detailed perspective view of the driving shaft of the embodiment of FIG. 1.
Figure 4:
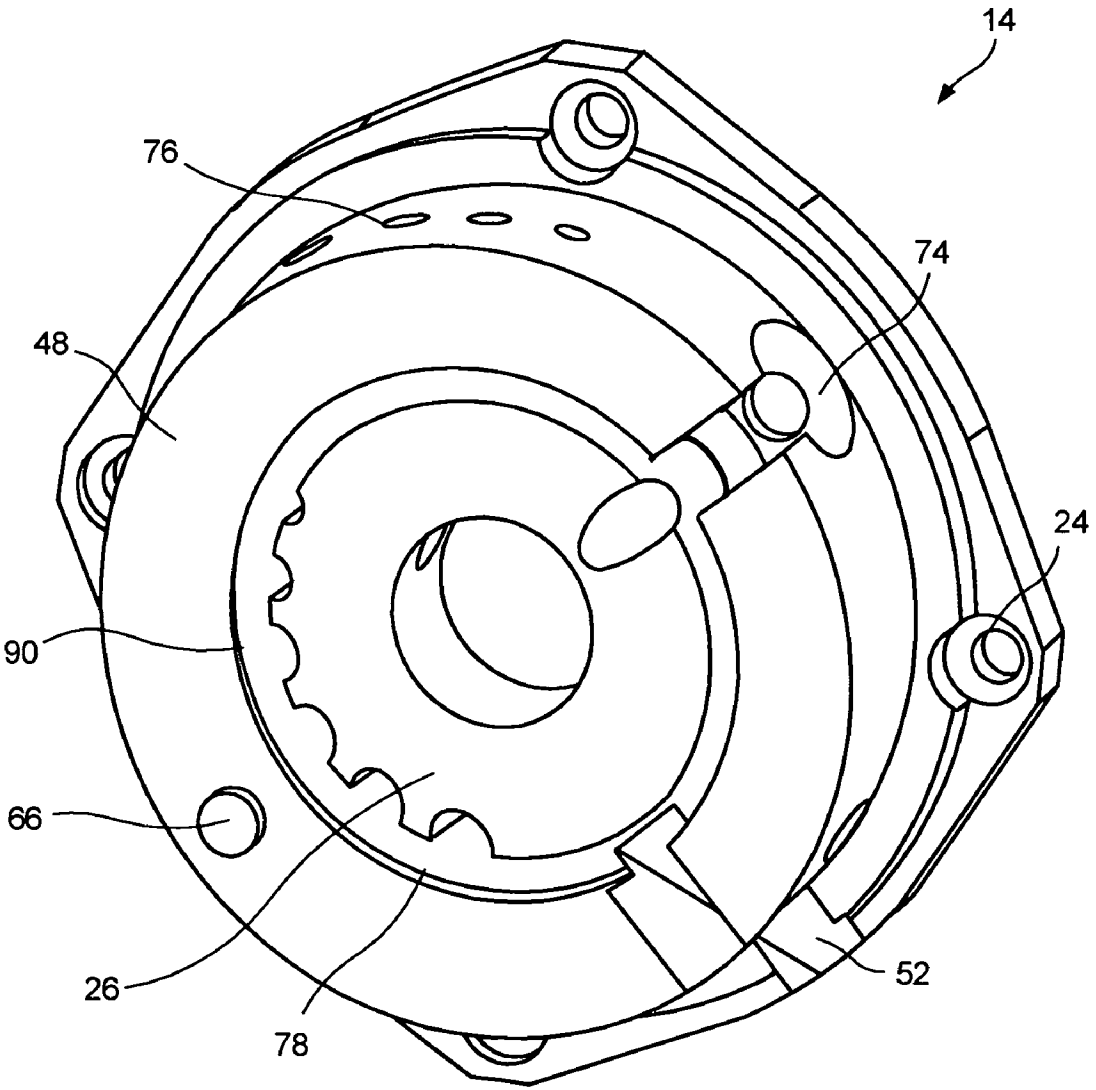
FIG. 4 is a detailed perspective view of the motor flange with openings for guiding welding electrodes according to the first embodiment of the invention.

In FIG. 4 the motor flange 14 is separately shown. The flange 14 is provided with bore holes 24. The flange is screwed to the motor through these bore holes as shown in FIG. 1. A plate like depression 26 is provided on the end of the motor flange 14 which is remote to the motor. This depression serves as a receiving unit for the grinding wheel assembly 18. This is shown in the exploded view of FIGS. 1 and 2. A connecting shaft 30 is screwed above the grinding wheel assembly 18. The connecting shaft 30 is separately shown in FIG. 3. The shaft 30 has an upper portion 28. Furthermore the shaft 30 has an internally threaded bore hole 32. The bore hole 32 is provided with a collar 34 projecting outwardly in an axial direction. The grinding wheel assembly 18 is set on this collar acting as a centering means.

The grinding wheels of the grinding wheel assembly 18 are provided with a central bore hole 38 and an off-axis bore hole 40. The central bore hole 38 is positioned and centered on the collar 34. The rotation is effected about the axis of the bore hole 38, a pin 36 engaging the bore hole 40 and transmitting the driving power to the grinding wheel assembly 18. The grinding wheel assembly 18 is fixed with the screw 37 in the inner thread of the shaft 30.

Figure 11:
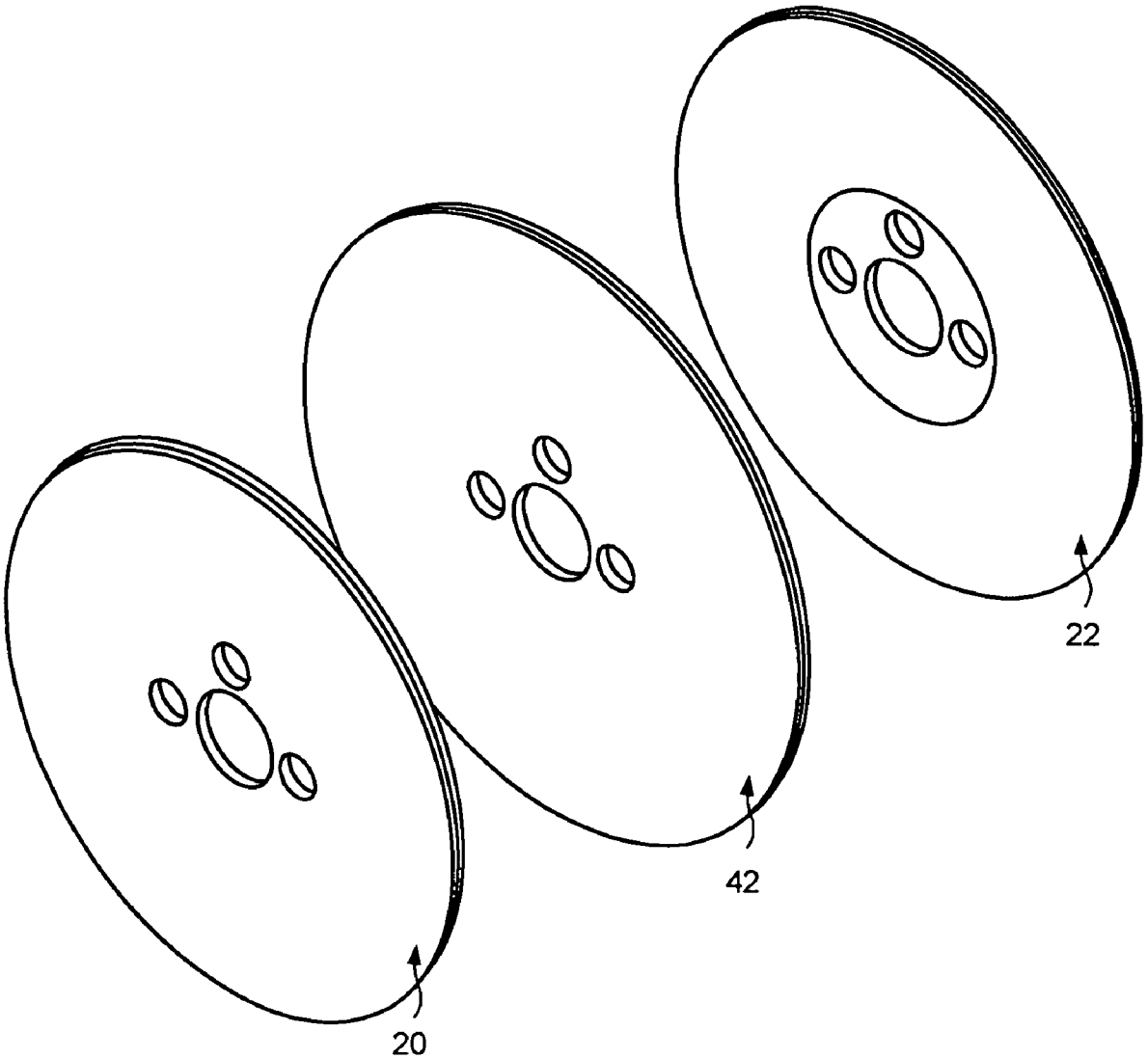
FIG. 11 shows the exploded grinding wheel assembly.

FIG. 11 shows the exploded grinding wheel assembly 18 with a cutting wheel 42 in the middle and grinding wheels 20 and 22 on both sides thereof, the grinding wheels having either the same, a different or a partial graining.

Figure 10:
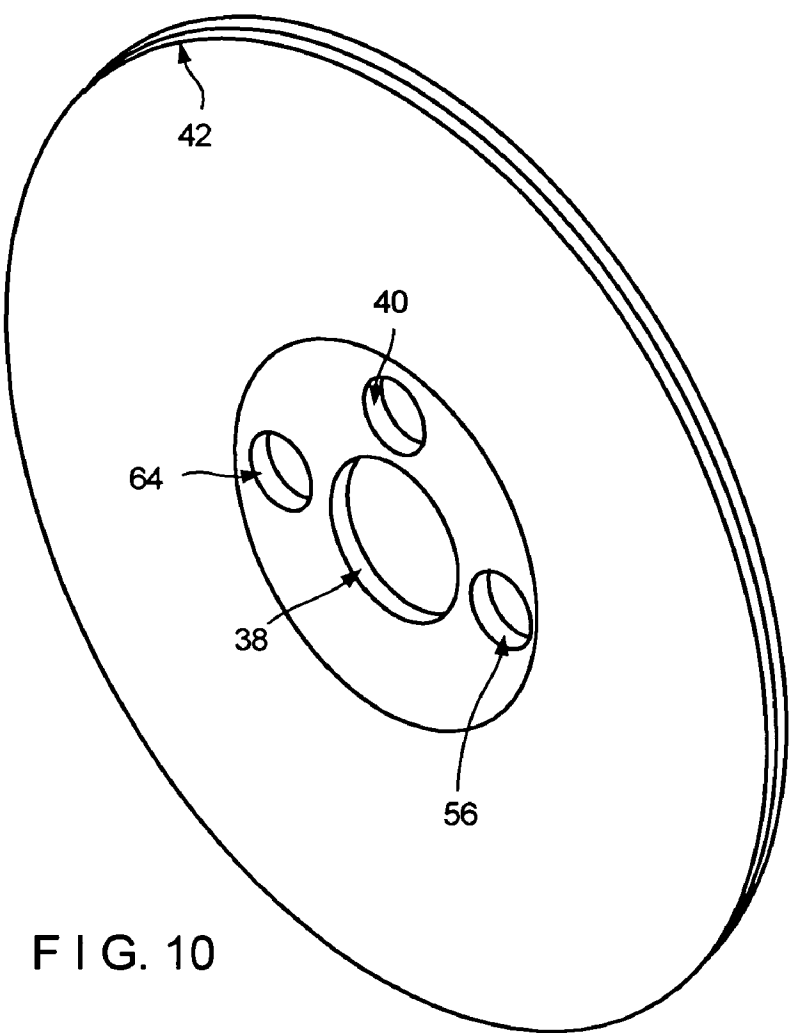
FIG. 10 shows the second grinding wheel of the grinding wheel assembly.
Figure 9:
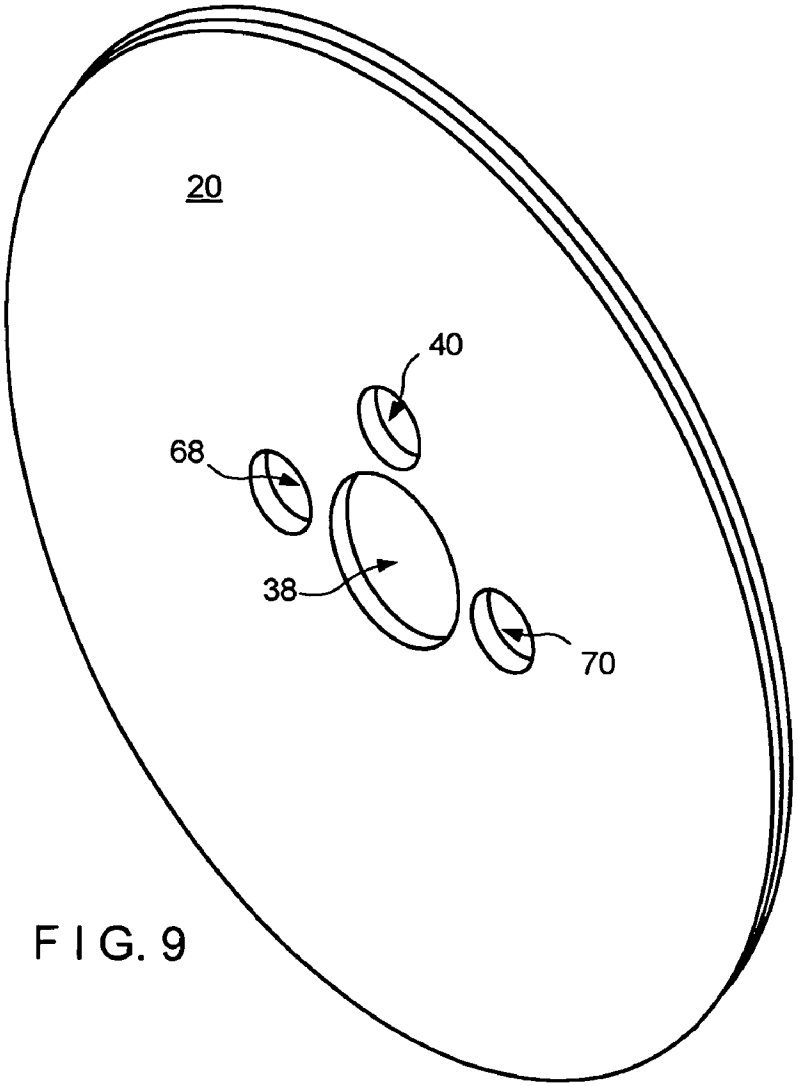
FIG. 9 shows the first grinding wheel of the grinding wheel assembly.

The grinding wheel assembly 18 comprises a rough grained grinding wheel 20 (FIG. 9) and a fine grained grinding wheel 22 which otherwise has the same constitution. A further middle wheel 42 is disposed between the two grinding wheels 20 and 22 of the grinding wheel assembly the middle wheel 42 having a particularly thin edge. This edge serves for cutting the electrodes with improved cutting behaviour. Additionally to the central bore hole 38 and the off-axis bore hole 40 for a fixed connection of the wheels 20, 22 and 42 further off-axis bore holes 64 and 56 are provided in the middle wheel 42 (FIG. 10). Projections 68 provided on the wheel 20 extend through each of the holes into the corresponding recess in the wheel 22 and a projection on the wheel 22 extending into the corresponding recess 70 in the wheel 20.

If the grinding wheel assembly 18 is mounted with the shaft the essentially cylindrical housing portion 16 is coaxially arranged on the motor flange 14.

Figure 5:
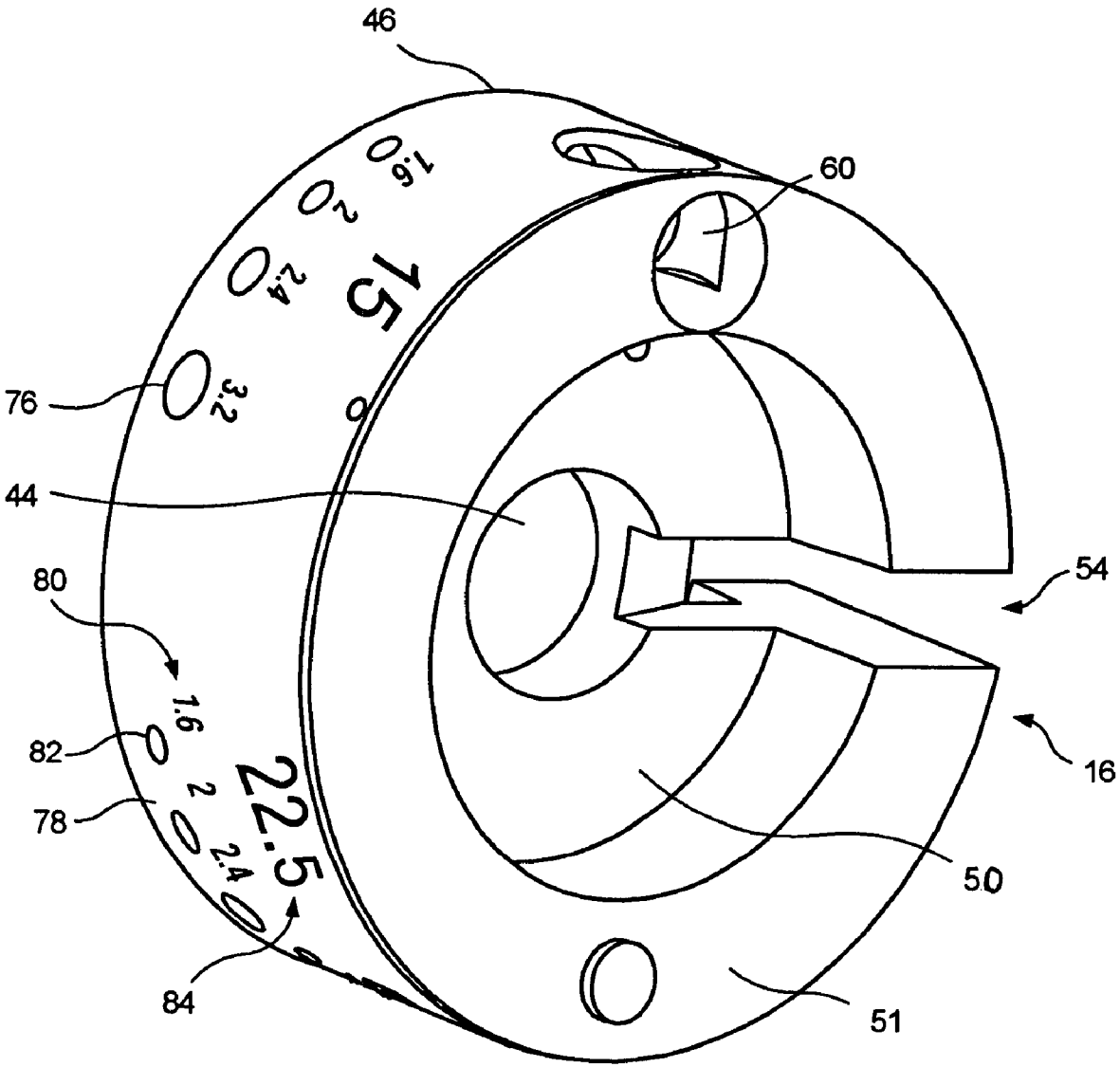
FIG. 5 is a detailed perspective view of the housing according to the first embodiment of the invention.
Figure 6:
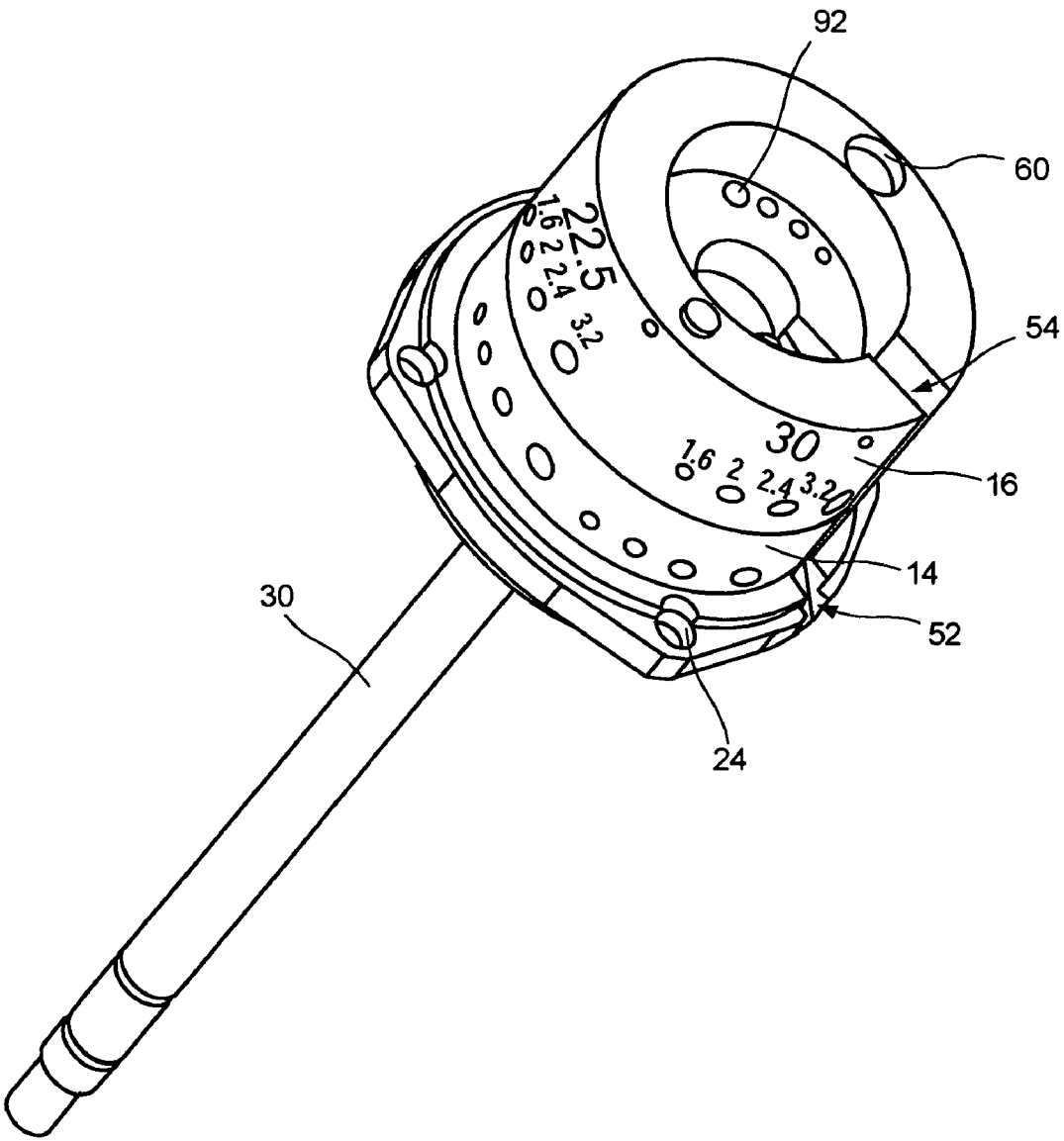
FIG. 6 shows the motor flange with the shaft and the housing of the first embodiment of the invention in an assembled state.
Figure 7:
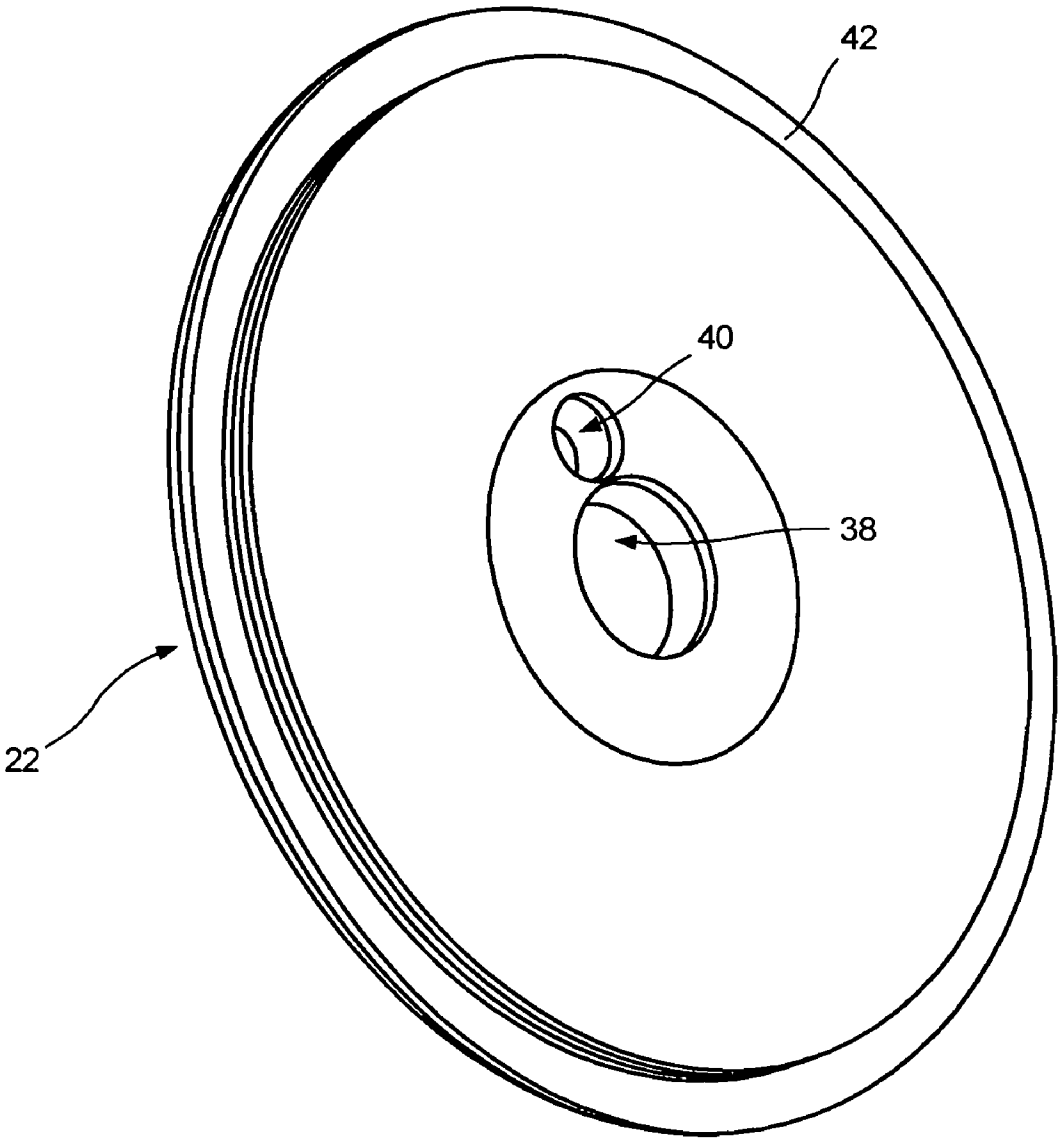
FIG. 7 shows the grinding wheel assembly in detail.
Figure 8:
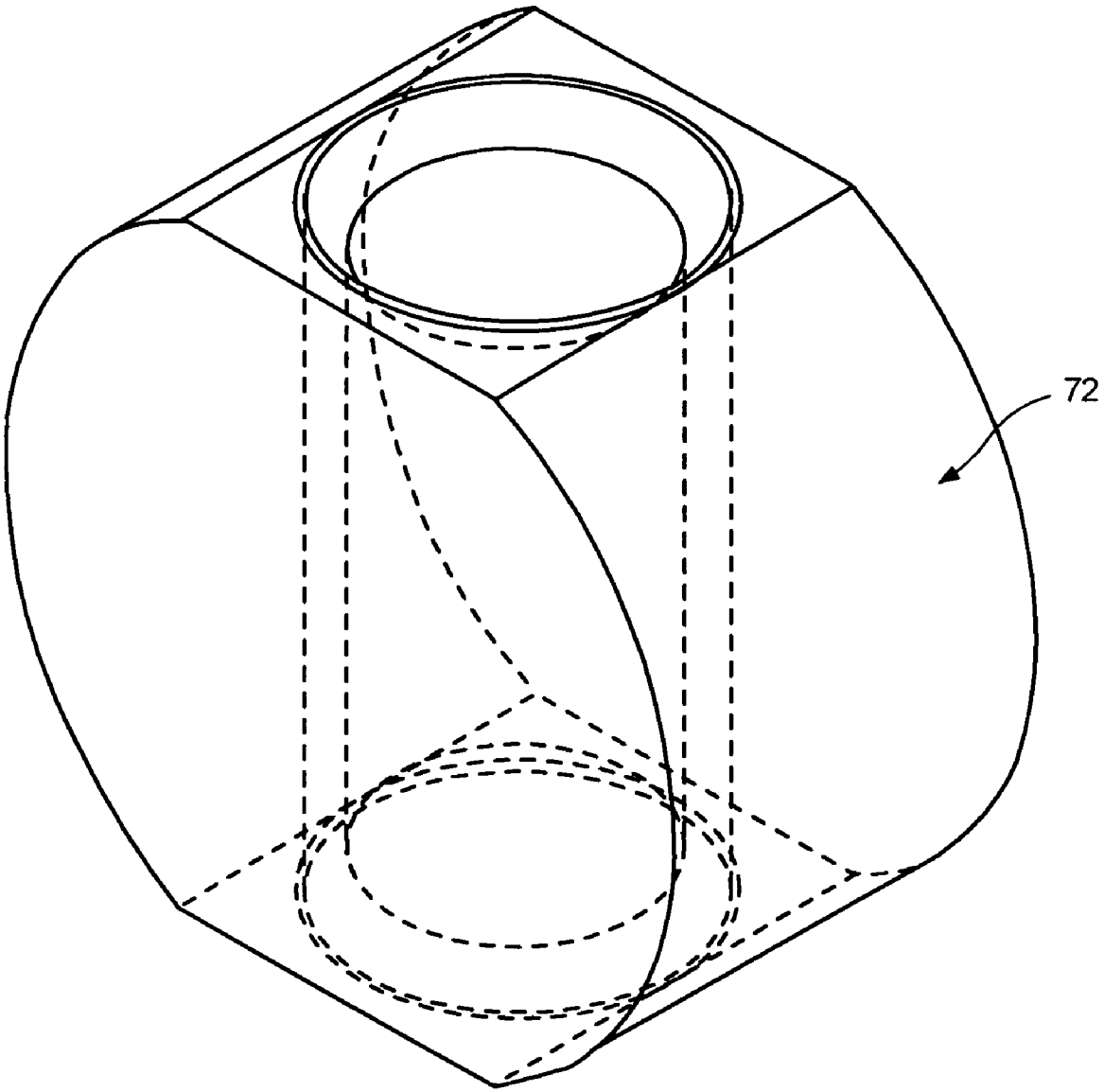
FIG. 8 shows the connecting nut in detail.

The housing portion 16 is shown in detail in FIG. 5. The housing part 16 has a center bore hole 44. The center bore hole 44 is aligned with the bore holes 38 of the grinding wheel assembly 18 and the rotational axis of the shaft 30. A depression 50 is provided around the bore hole at the plane surface 46 of the housing (see FIG. 2). This depression 50 has about the same dimensions as the depression 26 in the motor flange 14. The depressions 26 and 50 together form a cavity when the assembly is assembled (FIG. 6). The cavity serves to receive the grinding wheel assembly 18. The housing 16 has a depression 52 on its plane surface 51 on the upper end serving for receiving means for the removal of grinding leftovers such as dust and other leftovers. Furthermore the housing 16 has a slit 54 in a radial direction extending along the entire width of the housing. The slit 54 is wide enough to insert electrodes. When the grinding wheel assembly 18 rotates the electrode can be shortened at the middle wheel 42 by cutting off the worn end of the electrode. As in the housing 16 a slit 52 is provided in the motor flange 14. The slits 52 and 54 in the motor flange and in the housing 16 are aligned as it is shown in FIG. 6.

Figure 2:
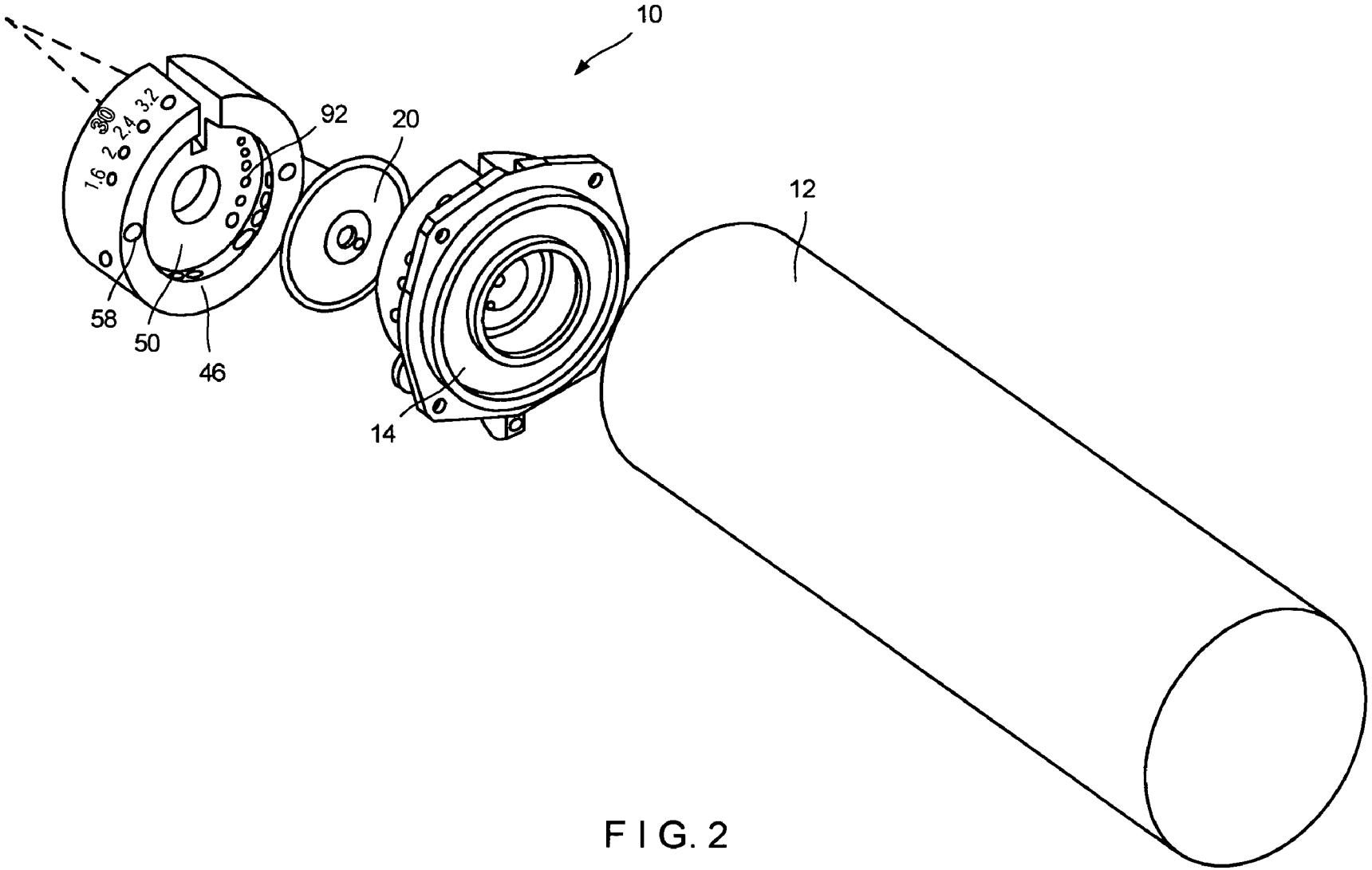
FIG. 2 is an exploded view of the device of FIG. 1 with a view from the lower end of the housing components.

A bore hole 60 is provided in the housing 16. The bore hole 60 extends over the entire length of the housing. A screw 62 (FIG. 1) engages through the bore hole 60 for screwing the housing 16 to the motor flange 14. The screw 62 is screwed into a nut 72 which is provided in a recess 74 in the motor flange 14. The motor flange has a pin 66 whereon the housing 16 can be inserted with a bore hole 58 (FIG. 2). In such a way the housing 16 is tightly fixed to the motor flange 14 by only one screw (62). This enables a particularly simple and quick disassembling and assembling if a grinding wheel must be exchanged. Contrary to known assemblies with two grinding wheels a shaft 30 with a particularly short neck may be used in the present assembly.

The housing 16 and the motor flange 14 have groups 76 and 78 of lateral openings. These groups of lateral openings extend along the circumference of the housing and the motor flange, respectively, in the direction of the grinding wheel next to the housing or motor flange, respectively, on the plane end 48. Each group comprises six lateral openings 82 of different diameter which is indicated by an engraving 80 over the lateral opening. The angle under which an electrode is inserted in a lateral opening 82 contacts a grinding wheel is the same within each group of lateral openings. It can be seen from the drawing, that the lateral opening 82 has a diameter of 1.6 mm and a grinding angle of 22.5 degrees. The angle for each group is indicated by a further engraving 84 above the first engraving. In the present embodiment there are four different angles possible for grinding the electrode tips. Also, electrodes with as many as up to six different diameters can be used. The electrode is so well guided by the lateral opening 82 that reproducible results can be achieved without any expense or danger.

More grinding angles, further electrode diameters or the use of a grinding surface with different graining are considered by providing similar lateral openings 90 in the motor flange 14. An electrode can be, for example, roughly pre-grinded by guiding it through the opening 82 in the housing 16. The grinding wheel 22 having a grinding surface which is upwardly directed has a rough graining. For the fine grinding the opening 90 in the motor flange 14 is used. The corresponding grinding wheel 20 having a grinding surface which is downwardly directed has a fine graining.

Furthermore, the housing 16 has a group of openings vertically extending from the upper end to the lower end of the housing 16. The openings of this group also have different diameters corresponding to the diameters of the previously mentioned groups. The openings of the group 92 enable the perpendicular grinding of the electrode tips.

The entire assembly is screwed on a hand-held unit. The grinding wheel assembly is positioned directly in front of the ball bearing of the motor shaft. This prevents lurching at high angular rates.

The assembly is much shorter than comparable assemblies having two grinding wheels. It is, therefore, much easier to handle. It requires less components and it is thereby cheaper in transport, keeping and production.

Figure 12:
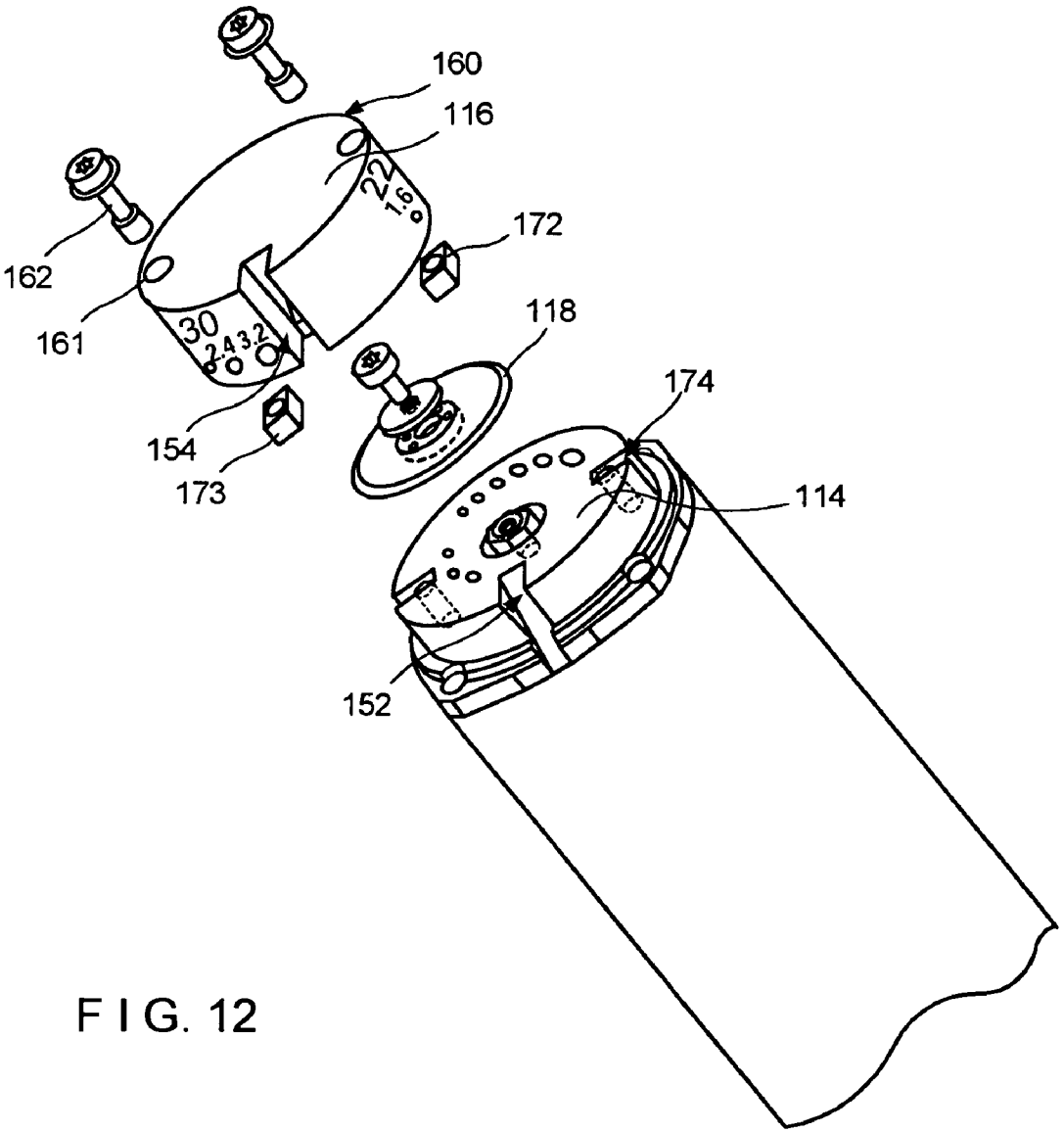
FIG. 12 shows an exploded view of a device according to a second embodiment of the invention.
Figure 13:
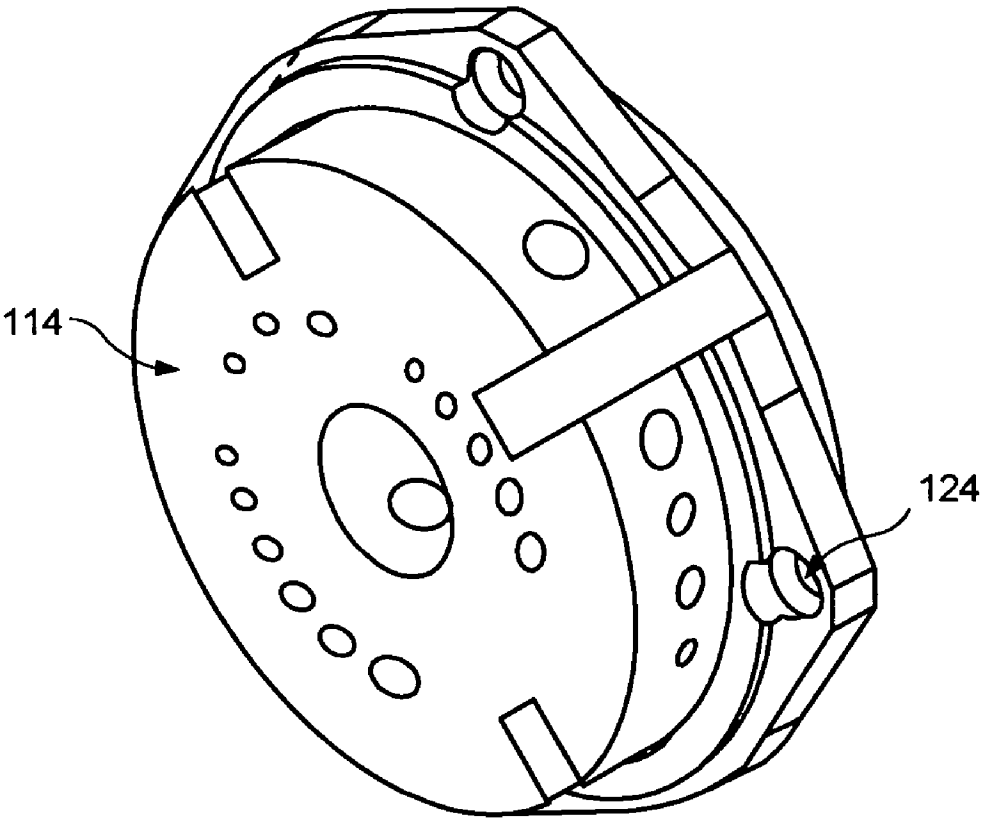
FIG. 13 is a perspective view of the motor flange according to a second embodiment of the invention.
Figure 14:
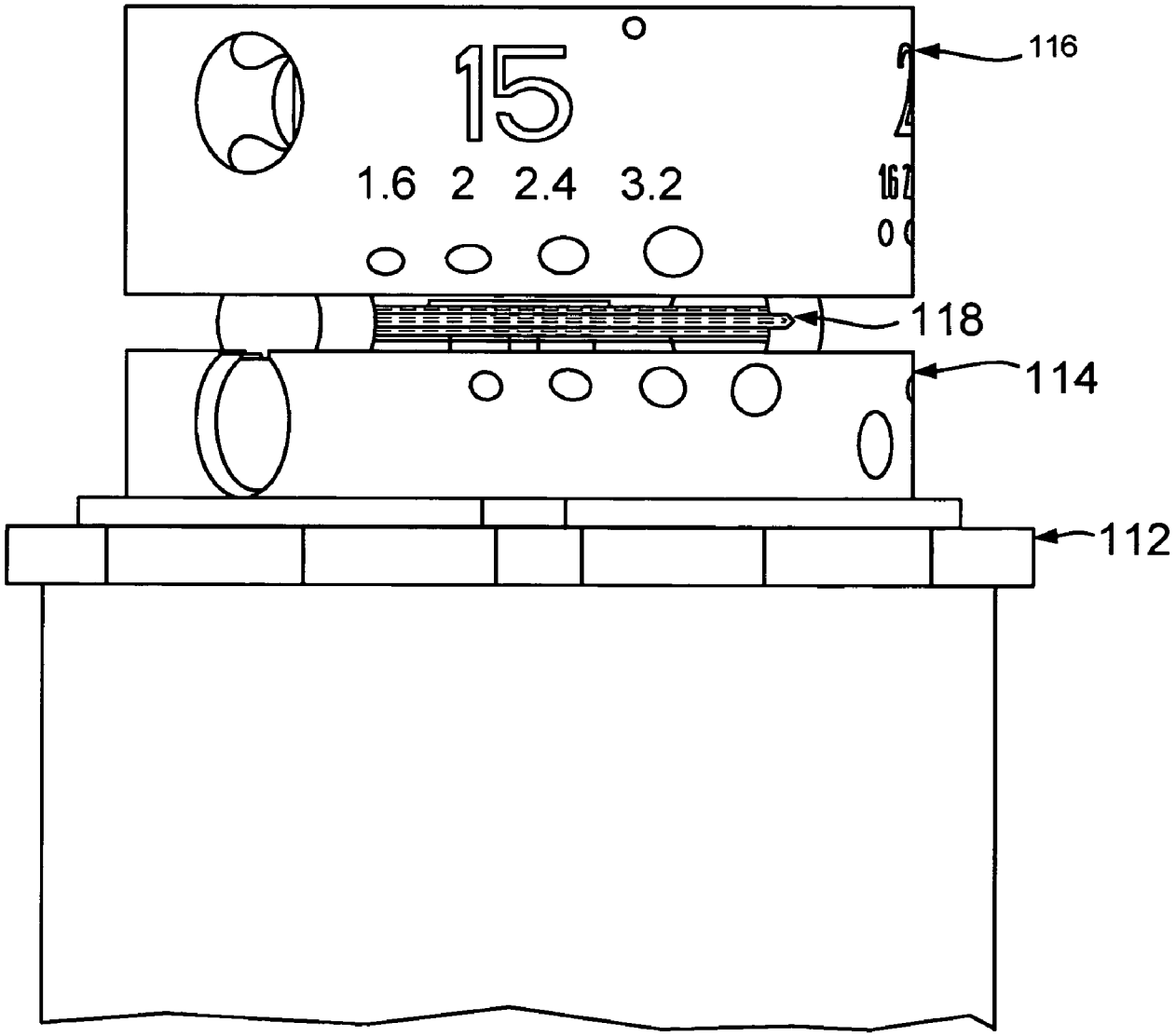
FIG. 14 is a cross sectional view of the device of FIG. 12.

An alternative embodiment is shown in FIGS. 12-14. A grinding wheel assembly 118 is provided, which is the same as the grinding wheel assembly 18 of FIG. 1. The grinding wheel assembly 118 is driven by a motor through a shaft. The grinding wheel assembly 118 is disposed between a motor flange 114 and a guiding block 116.

In FIG. 13 the motor flange 114 is separately shown. The flange 114 is provided with bore holes 124. The flange is screwed to the motor through these bore holes as shown in FIG. 12. The motor flange 114 constitutes a solid guiding block. The grinding wheel assembly 18 is disposed between the guiding block 116 and the motor flange 114. This is shown in the exploded view of FIG. 12 and the cross sectional view in FIG. 14.

In this embodiment, the housing portion 116 does not need a center bore hole or a depression. The housing 116 has a slit 154 in a radial direction extending along the entire width of the guiding block. The slit 154 is wide enough to insert electrodes. When the grinding wheel assembly 118 rotates the electrode can be shortened by cutting off the worn end of the electrode. As in the guiding block 116 a slit 152 is provided in the motor flange 114. The slits 152 and 154 in the motor flange and in the housing 16 are aligned as it is shown in FIG. 12.

Two bore holes 160 and 161 are provided in the guiding block 116. The bore holes 160 and 161 extend over the entire length of the guiding block. Screws 162 engage through the bore holes 160 and 161 for screwing the housing 116 to the motor flange 114. Two nuts 172 and 173 are provided to maintain a distance between the motor flange 114 and the guiding block 116. The grinding wheel assembly 118 rotates in the space between the motor flange 114 and the guiding block 116. The screw 162 extends through the nut 172 into a bore hole 174 in the motor flange 114.

The guiding block 116 and the motor flange 114 have groups of lateral openings as it is the case with the housing of the first embodiment.

Figure 15:
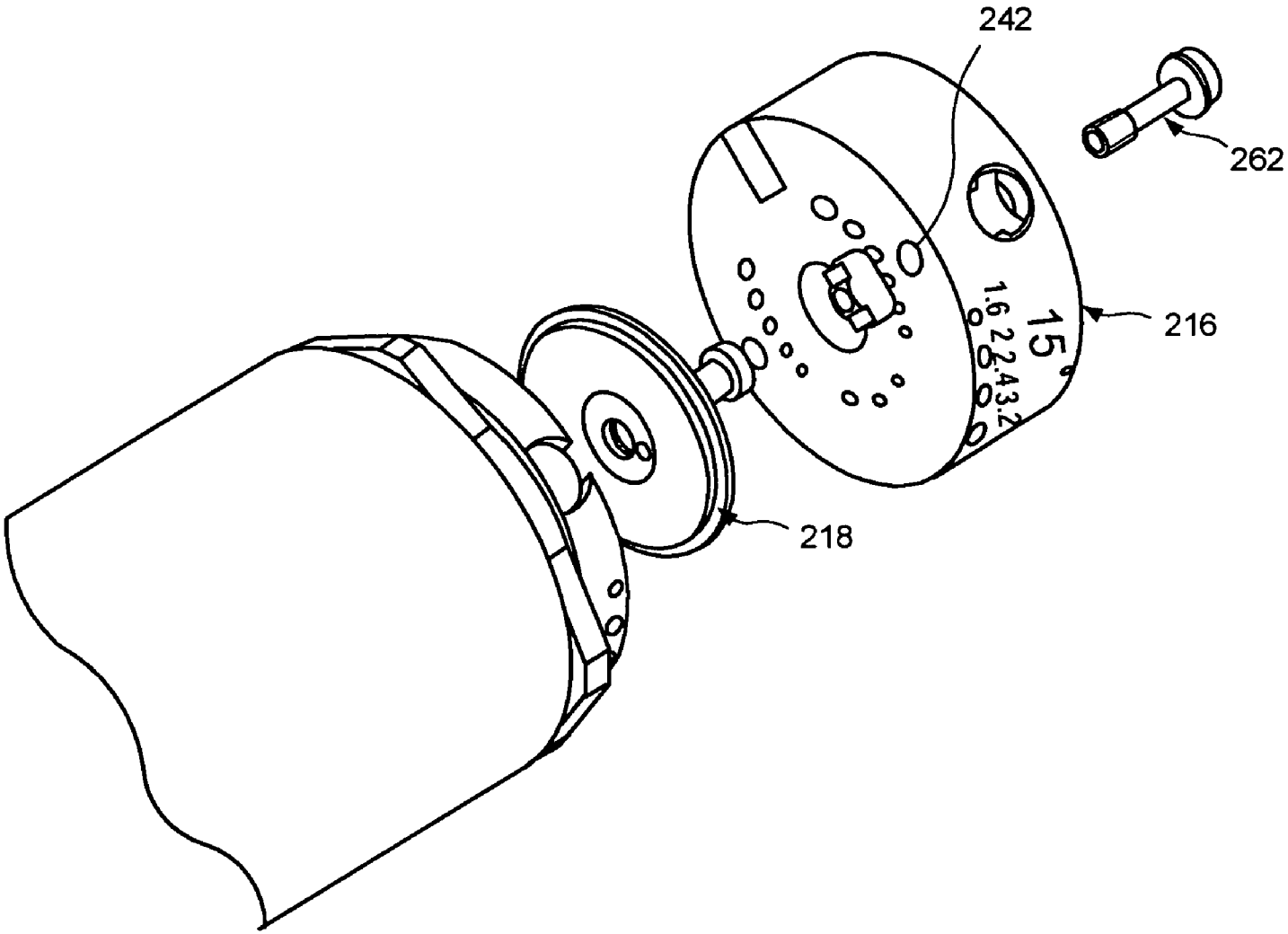
FIG. 15 is an exploded view of a device for processing welding electrodes with several connected grinding wheels with a view from the lower end on the components according to a third embodiment of the invention.

In an alternate embodiment only one screw 262 can be utilized. This enables a quicker assembling and disassembling if, for example, the grinding wheel 218 is exchanged. This screw 262 extends through a bore hole 242, as it is shown in FIG. 15.

Figure 16:
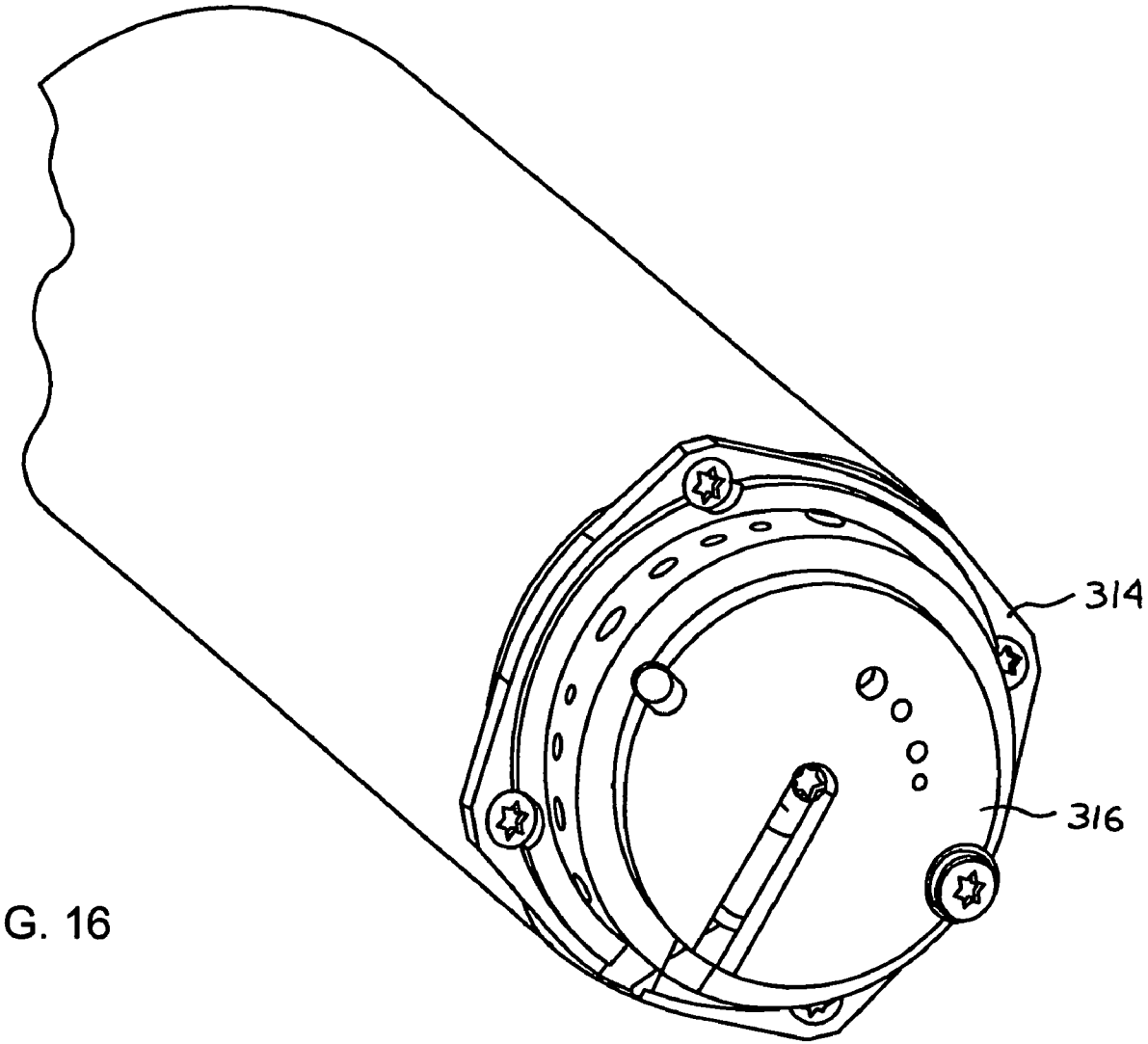
FIG. 16 is a perspective view of a motor flange according to the fourth embodiment of the invention.
Figure 17:
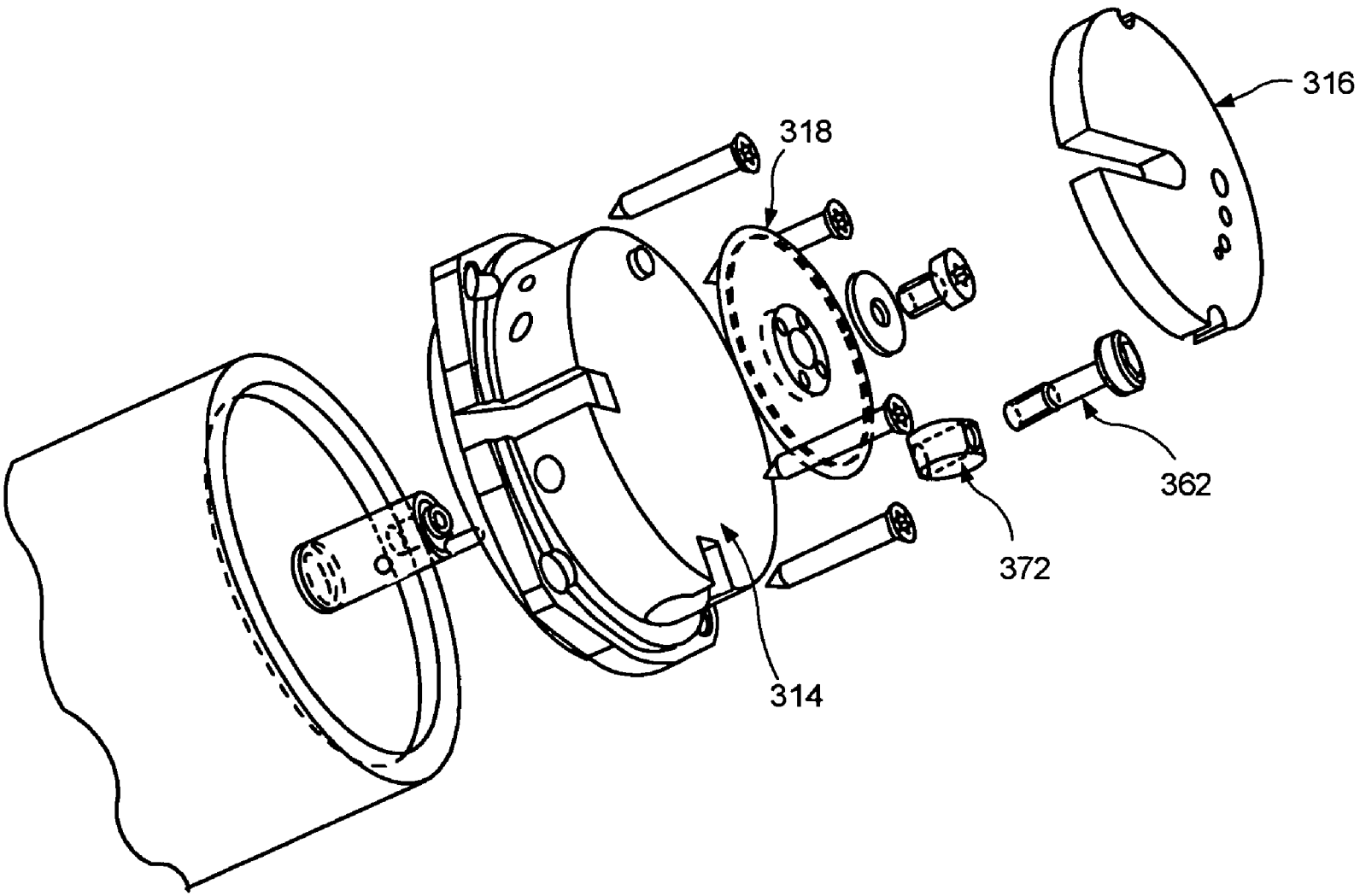
FIG. 17 is an exploded view of the device of FIG. 16.

A further alternative embodiment is shown in FIG. 16 and FIG. 17. A grinding wheel assembly 318 is provided, which is the same as the grinding wheel assembly 118 of FIG. 12. Contrary to the second embodiment the guiding block 316 does not have lateral openings. It is, therefore, much flatter than the guiding blocks or housings of the previous embodiments. As in the third embodiment, the guiding block 316 is fixed to a motor flange 314 by means of only one screw 362 and a nut 372. The guiding block 316 constitutes a lid for protection of the grinding wheel assembly 318. It also serves to grind electrodes flat without tip.

Figure 18:
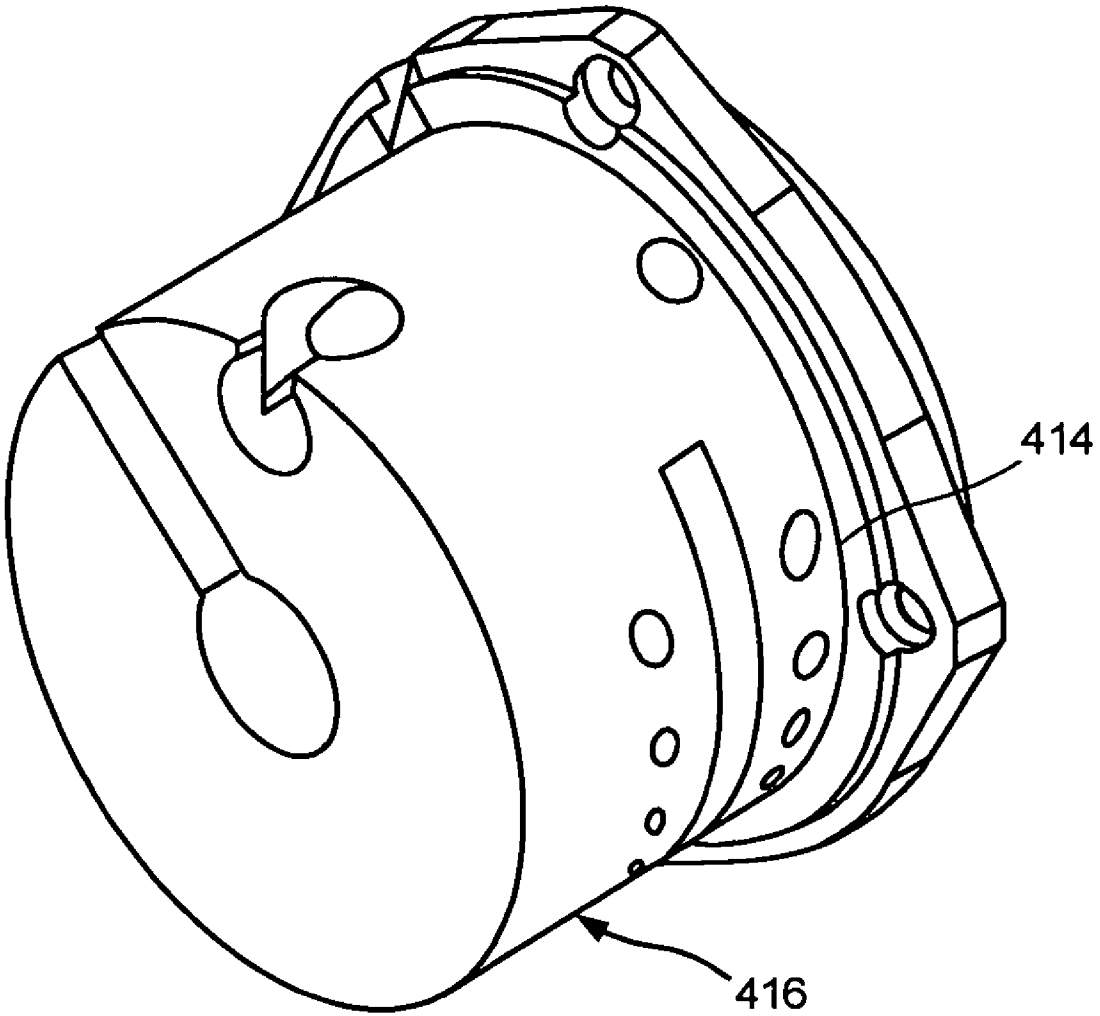
FIG. 18 is a perspective view of a fifth embodiment of the invention with an integrated guiding block.

FIG. 18 shows an embodiment which is similar to the embodiment of FIGS. 16, 17. However, instead of a screw 362 and a nut 372 the guiding block 416 forms an integral part of the motor flange 414. The entire part is screwed to the motor housing. The grinding wheel assembly (not shown) rotates therebetween.

In all embodiments, the grinding wheel assembly has a first grinding surface which is directed into a direction towards the motor. Thereby, the motor flange can be used as a guiding block.

What is claimed is:

1. A device for grinding welding electrodes comprising:

a driving motor;

a shaft driven by said driving motor;

a single grinding wheel driven by said driving motor though said shaft;

a first guiding block forming a part of a motor flange comprising a rear wall adapted for engagement with a motor, a front wall separated from said rear wall by a side wall, a first depression provided at the front wall;

a first and a second grinding surfaces facing opposite directions;

at least one first opening passing though said first guiding block between said side wall and said first depression, said first opening defining a position relative to said first grinding surface and said opening being adapted to guide a welding electrode for grinding into said defined position relative to said first grinding surface; and a second guiding block having at least one second opening, said second opening defining a position relative to said second grinding surface and said second opening being adapted to guide a welding electrode for grinding into said defined position relative to said second grinding surface;

a space defined between said first depression of the first guiding block and said second guiding block; and wherein said first and said second grinding surfaces of said grinding wheel are positioned within said space between said first and second guiding blocks.

2. A device for grinding welding electrodes as claimed in claim 1, wherein the grinding surfaces of the first and the second grinding surfaces have a different graining.

3. A device for grinding welding electrodes as claimed in claim 1, wherein the first grinding surface is provided on a first grinding wheel portion and the second grinding surface is provided on a second grinding wheel portion, said first and said second grinding wheel portion being assembled to form the grinding wheel.

4. A device for grinding welding electrodes as claimed in claim 3, wherein a wheel with a larger diameter is provided between said first and second grinding wheel portions for lateral cuffing of electrodes.

5. A device according to claim 4, wherein one or more further guiding blocks are provided which are attached to said guiding block.

6. A device for grinding welding electrodes, comprising:

a driving motor having a motor flange, said motor flange comprising a rear wall engaging the driving motor and a front wall separated from said rear wall by a side wall, a first depression formed at said front wall;

a shaft driven by said driving motor;

a grinding wheel driven by said shaft, said driving wheel having first and second grinding surfaces opposing each other, said grinding wheel being at least partially positioned within said first depression;

a first guiding block forming an inseparable part of the motor flange, at least one first opening passing through said first guiding block between said side wall and said first depression, said at least one first opening adapted for guiding welding electrodes;

a second guiding block having at least one second opening, said at least one second opening adapted for guiding the welding electrodes for grinding;

a working space defined between said first depression of the motor flange and said second guiding block, said working space receiving said grinding wheel in such a manner that said at least one first opening guides the respective welding electrode within said motor flange relative to said first grinding surface and said at least one second opening guides the respective electrode relative to said second grinding surface of the grinding wheel.

7. A device for grinding welding electrodes as claimed in claim 6, wherein said motor flange has an uninterrupted body, said at least one first opening comprises a plurality of the first openings passing said uninterrupted body of the motor flange between said side wall and said first depression.

8. A device for grinding welding electrodes as claimed in claim 7, wherein said first depression is formed by an inner surface extending from said front wall toward said rear wall of the motor flange and a base surface transverse to said inner surface.

9. A device for grinding welding electrodes as claimed in claim 8, wherein said plurality of the first opening extends within said uninterrupted body of the motor flange between said side wall and said base surface of the first depression, so as to guide the respective electrodes though said uninterrupted body of the motor flange to the first grinding surface.

10. A device for grinding welding electrodes as claimed in claim 6, wherein a second depression is formed within said second guiding block and is adapted to partially receive said grinding wheel, said at least one second opening comprises a plurality of second openings passing through the second guiding block into the second depression to guide the respective electrodes to the second grinding surface.

11. A device for grinding welding electrodes as claimed in claim 9, wherein said motor flange is formed with a longitudinal slit passing said body of the motor flange from said front wall, through said side wall to said rear wall.

12. A device for grinding welding electrodes, comprising:

a driving motor having a motor flange, said motor flange comprising a rear wall engaging the driving motor and a front wall separated from said rear wall by a side wall, a shaft driven by said driving motor;

a grinding wheel driven by said shaft, said grinding wheel having first and second grinding surfaces opposing each other;

a first guiding block forming an inseparable part of the motor flange, at least one first opening passing through said first guiding block between said side wall and said front wall, said at least one first opening adapted for guiding welding electrodes;

a second guiding block having at least one second opening, said at least one second opening adapted for guiding the welding electrodes; and said motor flange and second guiding blocks are spaced from each other so as to form an uninterrupted hollow working space therebetween, said hollow working space receiving said grinding wheel in such a manner that said at least one first opening guides the respective welding electrode within said motor flange relative to said first grinding surface and said at least one second opening guides the respective electrode relative to said second grinding surface of the grinding wheel.

13. A device for grinding welding electrodes as claimed in claim 12, wherein said motor flange has an uninterrupted body, said at least one first opening comprises a plurality of the first openings passing said uninterrupted body of the motor flange between said side wall and front wall.

14. A device for grinding welding electrodes as claimed in claim 13, wherein said plurality of the first openings extends within said motor flange between said side wall and said front wall, so as to guide the respective electrodes through said motor flange to the first grinding surface rotatably situated within said hollow working space.

15. A device for grinding welding electrodes as claimed in claim 12, wherein said at least one second opening comprises a plurality of second openings passing through the second guiding block, so as to guide the respective electrodes into the hollow working spaces, and to face the second grinding surface.

16. A device for grinding electrodes as claimed in claim 12, wherein said spaced from each other motor flange and second guiding block are connected by at least two members passing within said hollow working space and facing said grinding wheel.

17. A device for grinding welding electrodes as claimed in claim 12, wherein said front wall of the motor flange is substantially flat.

18. A device for grinding welding electrodes as claimed in claim 17, wherein said second guiding block is formed having substantially flat working surface facing said flat front wall of the motor flange, so that said second grinding surface of the grinding wheel and said substantially flat working surface of the second guiding block are spaced from each other without direct contacts therebetween.

* * * * *